United States Patent [19]

Kalbskopf et al.

[11] 4,419,570

[45] Dec. 6, 1983

[54] HEATING GLASS PANE

[75] Inventors: Reinhard Kalbskopf, Onex; Otto Baumberger, Carouge, both of Switzerland

[73] Assignee: Societa Italiana Vetro - SIV - S.p.A., San Salvo, Italy

[21] Appl. No.: 238,087

[22] Filed: Feb. 25, 1981

[30] Foreign Application Priority Data

Mar. 3, 1980 [CH] Switzerland ..... 1658/80

[51] Int. Cl.[3] ..... H05B 3/06

[52] U.S. Cl. ..... 219/522; 219/203; 219/543; 219/547; 338/308

[58] Field of Search ..... 219/203, 522, 543, 547; 338/211, 217, 308, 309; 428/412; 174/54; 29/620

[56] References Cited

U.S. PATENT DOCUMENTS

| | | | |
|---|---|---|---|
| 2,557,983 | 6/1951 | Linder | 219/543 |
| 2,564,677 | 9/1951 | Davis | 338/308 |
| 2,603,740 | 7/1952 | Del Buttero | 219/543 X |
| 2,761,945 | 9/1956 | Colbert et al. | 219/543 X |
| 2,833,902 | 5/1958 | Gaiser et al. | 219/547 |
| 2,932,710 | 4/1960 | Coale et al. | 219/544 |
| 3,245,023 | 4/1966 | Schmidt | 338/211 |
| 3,288,983 | 11/1966 | Lear, Sr. | 219/522 |
| 3,313,920 | 4/1967 | Gallez | 219/522 |
| 3,379,858 | 4/1968 | Peters | 219/522 |
| 3,475,588 | 10/1969 | McMaster | 219/203 |
| 3,813,519 | 5/1974 | Jochim et al. | 219/522 |
| 4,017,661 | 4/1977 | Gillery | 428/412 |
| 4,246,467 | 1/1981 | Boaz | 219/522 |

FOREIGN PATENT DOCUMENTS

| | | |
|---|---|---|
| 1116234 | 5/1956 | France . |
| 7100524 | 10/1971 | France . |

*Primary Examiner*—Volodymyr Y. Mayewsky
*Attorney, Agent, or Firm*—Karl F. Ross; Herbert Dubno

[57] ABSTRACT

A heated defrosting glass pane contains an alternation of conductive or nonelectricity-conductive regions. The conductive regions are transparent while in a heated state and are arranged in such a manner that during defrosting, they alone, by themselves, provide a sufficient integral visibility through the glass pane, while at the same time the nonconductive zones remain opaque. The ratio of the integral surface between the conductive and nonconductive surfaces is $\frac{1}{8}$ to $\frac{1}{2}$.

1 Claim, 2 Drawing Figures

HEATING GLASS PANE

FIELD OF THE INVENTION

The present invention relates to a glass pane heatable by the Joule effect, to a process for manufacturing the pane and to a device for carrying out the process. Such a glass pane, which is heated by the passage of an electric current through a conductor, can be used for the defrosting and demisting windows in vehicles in cold weather. It is also usable in other fields, especially in housing. It has at least on one of its surfaces a succession of electrically nonconductive regions or strips, alternating with regions or strips which are rendered conductive by CVD deposition (chemical deposition in vapor phase) of a layer of $SnO_2$, connectable with a source of a heating current. The regions are both transparent under normal conditions.

BACKGROUND OF THE INVENTION

It is known that the usual heated glass panes, especially those which are used for rear windows in automobiles, contain a network of electrically conductive wires or bands incorporated in the glass or applied on its surface. This network emits sufficient heat when it is connected to the terminals of the vehicle battery, in order to thaw the frost covering the abovementioned window and thus restore after a certain time to its normal transparent state. Of course, this defrosting action manifests itself first in the immediate vicinity of the conductive zone. The intermediate zones remain opaque for a certain time after the current is applied. As these conductive zones are generally opaque in themselves especially if they are strips of metallized paint, such a partial defrosting is insufficient for a time, to assure a total visibility through the glass pane; in fact, the glass pane does not have generally sufficient visibility until the defrosted zones are considerably extended on all sides of the conductive strips.

It was sought to remedy this inconvenience by making the conductive zones thinner and closer to each other or by the application on the glass of a conductive uniformly transparent layer, for example, a deposit of a conductive film of tin oxide with a thickness of several $\mu$m. Such solutions yield a practically homogeneous heating of the glass pane and its uniform defogging or defrosting. Nevertheless, such a remedy has a serious flaw, which is tied to the fact that the rise in temperature of a glass pane of a uniform thickness with a uniform conductive layer, occurs more slowly than in the favored zones situated in the immediate vicinity of the conductive strips of a classic heated glass pane. As a result, although a glass pane with a homogeneous conductive layer defrosts itself evenly, it does not become sufficiently transparent for effective vision until after it has been energized for a relatively long time.

Taking into account the fact that it is hardly possible in the case of the automobile to increase considerably the consumed electrical power and thus increase the defrosting speed (the accepted power for defrosting a rear car window is on the order of 5 to 250 W), the previously cited drawbacks have been overcome by concentrating the heating on certain transparent portions of the glass panes. These portions, once clarified, create a majority of transparent areas, the total of which assures a useful and sufficient visibility through this partially defrosted glass pane.

Thus, French Pat. No. 2.075.352 describes a heated glass pane comprising three transparent conductive regions, alternating with nonconductive regions (see page 2, lines 22–30 and FIG. 1). Though it is not specifically indicated in this reference that the transparency of the conducting zones alone give a sufficient vision through the glass pane, this seems to be evident enough from the disposition of these zones in FIG. 1 of the drawing.

With regard to the manufacturing of the transparent conductive regions, the above reference mentions the technique of deposition of bismuth oxide, covered with gold by vacuum deposition.

French Pat. No. 1.116.234 describes the deposition by atomization of a layer of $SnO_2$ on a glass plate, heated in such a manner as to form on it a transparent electricity-conductive film (see p. 1, col 2, lines 20–26). Nozzles spray horizontally an atomized solution against the glass plate, oriented vertically and perpendicularly to the atomized jets, and the panes are moved laterally in the field of the spraying of the jets. The operation is repeated back and forth until the desired thickness is obtained.

Moreover, it is indicated, p. 5, col. 1, lines 16–25, that the ends of the windshield (made out a glass plate) does not contain the deposit.

A third reference, the U.S. Pat. No. 2,833,902, concerns the deposits of layers of $SnO_2$ on the glass plates through atomization of a solution of an organic compound of tin. This process is illustrated by FIG. 4, where a set of four atomizing nozzles is seen spraying a solution of a tin compound on a heated substratum moved relative to the nozzles. Still it should be noted, that according to the sketch of FIG. 3 of the same patent the two superposed rows of traces left by the spraying from the nozzles, crisscross each other (this is evidently necessary in order to obtain a homogeneous layer on the surface of the entire plate), which can not be at all suitable for the depositing of the conductive strips, as is desired for the present invention.

A fourth reference, the French Pat. No. 1.165.645, concerns the depositing of transparent conductive layers in which the transmission does not exceed 72% (see p. 4, Example 4). These layers are obtained by depositing transparent metallic films on a transparent base. These films can contain gold, silver, copper, iron, nickel or other metals.

The U.S. Pat. No. 3,475,588 concerns defrosting glass panes containing a succession of contiguous heating regions. Each of these zones can be heated according to an independent program. It does not deal, therefore, with a glass which includes an alternation of conductive and nonconductive spaces as in the present invention.

The French Pat. No. 1.531.506 describes conductive glass panes which can contain either opaque resistances or, conductive transparent independent zones which cover the quasi totality of the glass pane surface (see p. 3, col. 2 at the top and FIG. 5). This arrangement is not advantageous, because it is much too similar to the technique in which the entire glass pane is heated, a solution whose drawbacks were described above.

A seventh reference, the U.S. Pat. No. 2,564,677, describes the preparation of conductive iridescent films, of oxides on substrates by the atomization of salt solutions. It does not seem that the last reference contains data applicable to the production of glass panes of the type of the invention, due to the lack of transparency of such iridescent deposits.

SUMMARY OF THE INVENTION

The glass pane of the invention solves the problems described above. This glass pane has an integral [total] ratio of all of the surfaces (A)/(B) which is lower than $\frac{1}{2}$ and especially is comprised between $\frac{1}{8}$ and $\frac{1}{2}$. Of course, the strips of the conductive regions (A), alternating with the strips (B) of the nonconductive region are connected to a source of heating current, that is to say that one end of each strip is connected to one terminal of the aforementioned source and the other end of each strip is connected to the other terminal. At room temperature, the regions (A) and (B) are both transparent and thus when it is a matter of thawing the glass pane, the integral surface ratio (A)/(B) is chosen in such a manner that the clearing of only zones (A) permit sufficient general vision through the glass pane. By "sufficient general vision" it is meant that the automobile driver can see without ambiguity the sides of the road and the eventual obstacles when he backs up, or, while in traffic, the presence of other vehicles behind him.

Preferably, the transparency, transmissivity or transmission of light of the regions (A) will not be less than 70–80% of the transparency of regions (B).

Most often, the zones (A) will be constituted of transparent conductive strips of a constant or nonconstant breadth, parallel to each other, on one or both surfaces of the glass pane. In the last case, the strips on one of the surfaces can be perpendicular to the strips of the other surface; thus the composite constitutes a heating grid. However, all sorts of other variants are possible, including one where one set of conductive strips is superposed on the same surface with another set, these being electrically separated from one and another by a transparent insulating layer. In a general manner the surface ratio (A)/(B) should not exceed about $\frac{1}{2}$ if it is desired actually to assure a rapid demisting or defrosting of the zones (A) without consuming too much current. Likewise, the regions (A)/(B) can be of any shape, provided that the assembly will conform with the above requirements. The material of the conductive strips should be accordingly at the same time transparent and sufficiently conductive. Such a material is tin oxide, deposited through a reaction in a vapor phase (CVD) Chemical Vapor Deposition. In effect the conductivity of the latter, particularly when it is deposited by CVD, is especially suitable, because it possesses a specific resistivity ($\rho$) in the order of about $10^{-3}$–$10^{-4}$ $\Omega$.cm. This resistivity decreases as the material warms up when the electrical current passes through it. Thus, if it is accepted that in the case of a homogeneous layer of $SnO_2$, deposited through CVD of 0.5 to 1 $\mu$m thickness, the values obtained will be $R_{\square}=1$ to 20 $\Omega$ and on the the other hand, the rear window of the automobile is 2 times wider than the height. This kind of a window, equipped with such a layer, will have a consumption of (with 12 volts), of about 75 to 150 W, which corresponds well to the power norms generally accepted. A heated glass pane can be made comprising horizontal strips of $SnO_2$ whose total surface constitutes a fourth of the useful surface of the glass pane and whose thickness is in order of 2 to 5 $\mu$m. Such a glass pane dissipates an electric power of 50 to 100 W, and after frosting the zones covered with $SnO_2$, recover their clarity much more rapidly than the uniform control glass pane mentioned before. The zones covered with $SnO_2$ have an excellent transparency and are not in any way an impediment to the visibility through the glass pane, because they are hardly noticed. It is understood that, if desired, a glass pane can be made where the superficial ratio of zone (A)/zone (B) is even smaller; instead of $\frac{1}{4}$, as above, it will be $\frac{1}{8}$ or less, and the thickness of $SnO_2$ of zones (A) will be from 4 to 8$\mu$ (for the same dissipation of energy). In this case a glass pane will be obtained in which the heated zones defrost still more rapidly than in the above mentioned case. However, the ratio (A)/(B) can not be reduced indefinitely, because in such a case the effect of the integral visibility provided by the thawed "zebra" will be insufficient (transparent areas too thin in relation to the total), and besides, if the layers of $SnO_2$ are too thick, they lose transparency and, in normal conditions, darken the general optic effect of the glass pane. On the other hand, it is impossible to increase too much the ratio (A)/(B) because in such a case it comes too close to the limit constituted by the uniform layer in which the defrosting is very slow. In a general manner it is preferred to have a conductive thickness of $SnO_2$ at least of 0.5 $\mu$m.

As seen above, a glass pane of the invention can be made by the usual techniques of depositing $SnO_2$ on glass through CVD. However, it is preferred to utilize a CVD instilling technique, of a common method described in detail in German patent document DOS No. 2.123.274. The fundamental element of the coating device is a nozzle of concentric jet pipes placed in the immediate proximity of the plate of glass and spraying on it, while heated, gas streams of the reactants (diluted in a carrying gas). The joining of the reactives gives rise to the formation of the $SnO_2$ deposit on the aforesaid plate. The plate is transversely mobile in relation to the jets of gas. The deposit takes the shape of a transparent strip, which adheres perfectly to glass, and whose breadth is determined by the dimensions of the jet pipe, and especially by those of the aspiration chamber for the reacted gas, and encircles the said nozzle. The dimensions determine also the dispersion radius of the gas coming from the nozzle on the plate. Consequently the breadth of the said conductive regions, which are produced by the reaction, is precisely determined by the function of this aspiration. Of course, the operative parameters (flowing speed of gas flux, concentration of the reactives etc. . . . ) play a role concerning the dimensions and the properties of the conductive zones. However, this method hardly permits exceeding in a single pass a thickness of 0.8 to 1 $\mu$m. In consequence the zones of the glass plate destined to become conductive can be subjected to several successive depositing passes for a transparent conductive coating. The number of passes are essentially a function of the final desired thickness. After the mixing of the reactants on contact with the plate, and the formation of a transparent deposit on it, the reacting gases are eliminated by aspiration into an immediate nearby region by the spraying device in such a way that these gases do not spread out without control on the plate, and maintain a sharp boundary between zones (A) and (B).

BRIEF DESCRIPTION OF THE DRAWINGS

The attached drawing illustrates the process of the invention.

SPECIFIC DESCRIPTION

Figure 1:
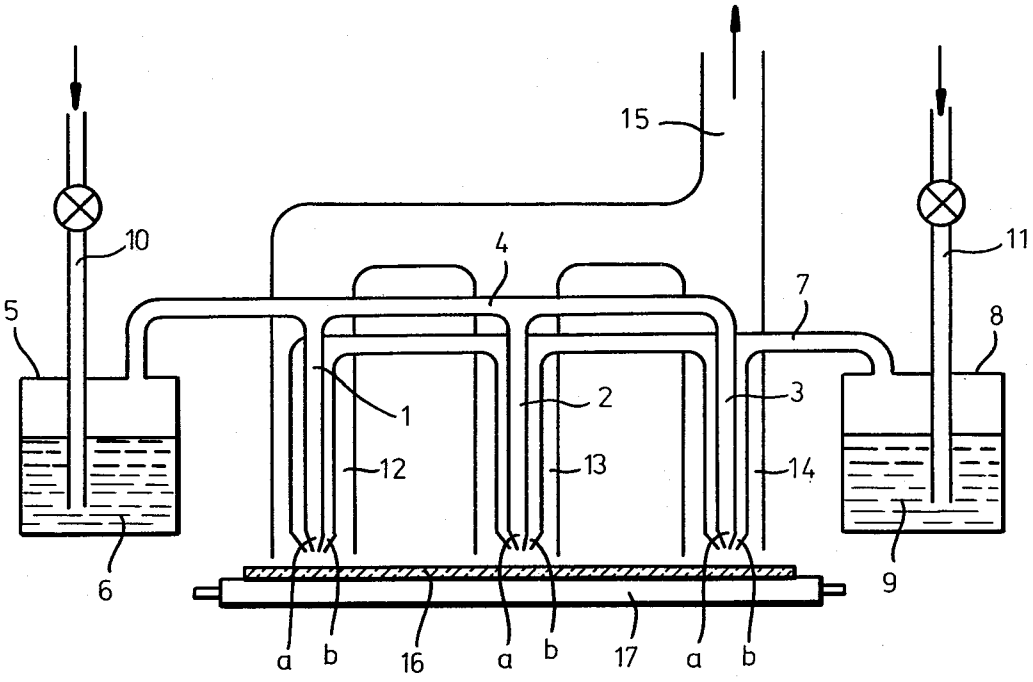
FIG. 1 represents schematically a coating device by CVD comprising a set of jet pipes arranged in such a way as to permit the realization of a glass pane according to the invention.

The depicted device comprises three nozzles 1, 2 and 3 (of course, more than three could be used), each of which has two concentric jet pipes designated respectively by the letters a and b. The central jet pipes a are joined by distribution piping 4 to a receiving mixer 5 which contains one of the reactants 6 and which permits the formation of a conductive transparent layer; in this case it is $SnCl_4$. The jet pipes b are joined by a distribution circuit 7 to a receiving container 8 which contains another reactants 9, in this case aqueous methanol. The device includes also the supply pipes 10, 11 of the gas carriers, descending into the reactants liquids; this gas is destined to vaporize at least in part. Included also are the evacuation chambers, respectively 12, 13 and 14; these chambers (or conduits) collect the by-products of the coating reaction, in this case HCL, and guide them towards an evacuation flue 15. The present device is arranged in an immediate proximity of a glass plate 16 to be covered with $SnO_2$. This plate is supported by rollers 17 in a manner as to assure its perpendicular movement in relation to the outflow of the gas flux. As was indicated in the drawing, the chambers 12, 13, 14 enclose tightly the nozzles 1, 2 and 3 respectively. Their size, and likewise, the aspiration suction which prevails in their interior, determines the dispersion range on the plate 16 of the gas issued from the said nozzles, and for that reason, the breadth of the said conductive regions.

The present device functions as follows:

the glass plate 16 is heated at a predetermined temperature, for example 500° to 600° C., by the means of an oven not represented on the drawing, and gradually is sent forward by the rollers 17, opposite the mouths of the nozzles 1, 2 and 3. A carrier gas is introduced through the conduits 10 and 11 according to a preestablished flow, for example a mixture of $H_2/N_2$, in a manner that it carries away through spraying, in the form of vapors, the reactants 6 and 9. The reactives enough simultaneously from the openings a and b of each of the jet pipes. These gases are sprayed on the plate, and when in contact with it, they react according to the reaction:

$$SnCl_4+2H_2O \rightarrow SnO_2+2HCl.$$

The $SnO_2$ deposits itself in the form of strips on the plate 16 and the formed HCl is carried away in the evacuation flue 15 in a controlled manner, in the company of the carrying gas and the products which have not reacted. Because of the concentric position of the evacuation chambers around the nozzles, the gas in contact with the plate 16, can not spread freely on the plate beyond the limits imposed by the dimension of the mouths of the said chambers. The result of this arrangement is the formation of deposits of $SnO_2$ whose boundaries clearly defined with a minimal diffusion onto the zones (B).

Then, with a single pass as described above, strips of $SnO_2$ are formed of a thickness in the vicinity of 0.5 to 0.8 μm. To make the glass pane according to the invention, several passes will be made, for example by repeatedly passing the plate backward and forward again. A number of repetitions are necessary for the conductive strips to acquire the thickness and conductivity chosen.

Of course, as a variant, a continuous working process can be arranged by setting up several rows of nozzles, placed one after the other, to work in the direction of the movement of the plate that is to be coated. Such an arrangement, which is not represented on the drawing, is easily understood by imagining two or more assemblies of the device as the one shown in the drawing, placed side by side, in a manner that the deposits from each of the successive nozzles overlap the deposit furnished by the preceding nozzle. In other words, the equivalent result is obtained by having the plate pass four times opposite the device of the drawing or by making it pass once opposite a battery of four similar units, while these units are placed in a manner that the trace of each unit overlaps the traces of the other units.

Figure 2:
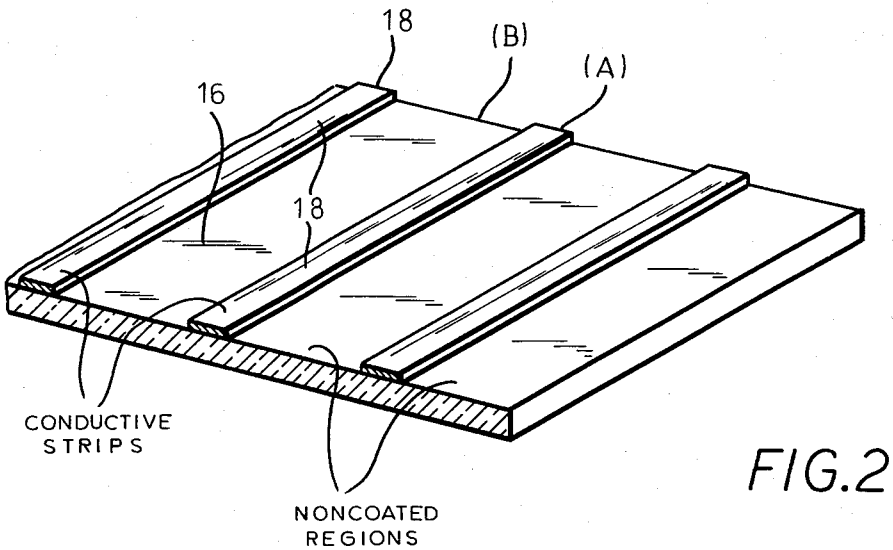
FIG. 2 represents schematically, partially in perspective a glass plate provided with conductive zones (A).

FIG. 2 represents the glass plate 16 covered with 3 conductive strips (A) with clear borders of a conductive transparent material 18, arrived at according to the invention. These strips alternate with nonconductive zones (B). The thickness of this material which is usually several μm, is greatly exaggerated in the drawing for obvious illustrative reasons.

POSSIBILITIES FOR INDUSTRIAL APPLICATION

The example which follows, illustrates the invention in a detailed manner:

An apparatus similar to the one represented in the drawing was constructed, but having 8 nozzles, spaced in 5 cm intervals per row and having 5 successive rows of nozzles. All the nozzle openings are disposed on the same plane; they have a diameter of 5 mm, and the inner jet pipe has a diameter of 2 mm. Each of the nozzles is enclosed by a cylindrical aspiration conduit coaxial with the nozzle, of 12 mm in diameter. These conduits, whose lower opening projects below the orifice of the nozzles by about 1 mm, leads to the evacuation flue, which was equipped with a conventional aspiration turbine (not represented in the drawing). The feeding of the nozzles was also made, as was schematically represented in the drawing, by means of the following reactants:

(a) $SnCl_4$ (inner jet pipes (a); carrying gas $N_2/H_2$ (60:40) with a flow of 200 l/h; delivery of $SnCl_4$ 2 ml/min.

(b) aqueous solution of 1% of HF (outside jet pipes b); carrying gas $N_2/H_2$ (60:400, the different flows being regulated by valves placed on the leading conduits of the carrying gases.

The depositing of $SnO_2$ on a glass plate of 4 cm thickness follows. It is heated to 600° C. and is being displaced at 8.5 m/min. opposite and parallel to the plane of the nozzle openings. The conditions of the deposit were as follows: nozzle temperature: 130° C.; aspiration of the formed HCl: 500 l/h.

The following results were obtained: breadth of the rectilinear regions 15 mm; thickness of the deposit 2.5 μm, resistivity $=10^{-3}$ Ω. cm; integral resistance of the glass pane $R_{\square}=0.4$ Ω.

Thus a glass pane of a height of about 30 cm was obtained. It had 5 conductive strips whose integral surface represents approximately ¼ of the total surface of the glass.

After having a strip of conductive paint applied on its lateral ends, a slab of this glass pane (60×30) was submitted to a test of frosting and standard defrosting in the following manner:

At −15° C., water was atomized on the slab, in a way as to cover it with a layer of thick frost and to make it absolutely opaque. Then the lateral conductive strips were connected to the terminals of a source of a direct current of 12 V. It was ascertained that at −15°, the conductive zones became clear in approximately 1 min, and allowed a sufficient general vision through the glass pane.

It should be noted that the glass pane of the invention can equally be realized by starting with a coated glass plate, with a homogeneous conductive layer of $SnO_2$. One part of that layer is therefore eliminated in such a way as to arrange an alternation of the conductive and nonconductive zones. For the partial elimination of the layer of $SnO_2$, the customary means can be used, especially a disk or polishing felt roller provided with an abrasive paste, a diamanted paste, for example.

We claim:

1. A glass pane heatable by the Joule effect comprising:

(a) a transparent glass plate having a pair of broad surfaces on opposite sides thereof; and (b) a plurality of mutually parallel, transparent, electrically conductive strips applied to one of said surfaces by vapor deposition coating of an $SnO_2$ layer thereon whereby said strips alternate with electrically nonconductive regions in which said glass plate is not coated, the strips defining a total area A and said regions defining a total area B, both said areas being transparent under normal conditions, said strips being electrically connectable to a source of a heating current, the ratio A/B of said areas being between $\frac{1}{8}$ and $\frac{1}{2}$, the transparency of said area A is not less than 70% of the transparency of said area B, said conductive strips having a resistivity of $10^{-3}$ to $10^{-4}$ Ω.cm and a thickness of 0.5 to 5.

* * * * *